US011154925B2

(12) United States Patent
Saini et al.

(10) Patent No.: US 11,154,925 B2
(45) Date of Patent: Oct. 26, 2021

(54) CONFIGURED TUNDISH

(71) Applicant: VESUVIUS U S A CORPORATION, Champaign, IL (US)

(72) Inventors: Khushwant Saini, Strongsville, OH (US); Donald Zacharias, Polk, OH (US); Thongxai Vouthy, Garden City, KS (US); John Morris, Strongsville, OH (US)

(73) Assignee: Vesuvius U S A Corporation, Champaign, IL (US)

( * ) Notice: Subject to any disclaimer, the term of this patent is extended or adjusted under 35 U.S.C. 154(b) by 0 days.

(21) Appl. No.: 16/765,384

(22) PCT Filed: Dec. 5, 2018

(86) PCT No.: PCT/US2018/064002
§ 371 (c)(1),
(2) Date: May 19, 2020

(87) PCT Pub. No.: WO2019/125765
PCT Pub. Date: Jun. 27, 2019

(65) Prior Publication Data

US 2020/0338633 A1 Oct. 29, 2020

Related U.S. Application Data

(60) Provisional application No. 62/609,239, filed on Dec. 21, 2017.

(51) Int. Cl.
*B22D 11/18* (2006.01)
*B22D 43/00* (2006.01)
(Continued)

(52) U.S. Cl.
CPC ..... *B22D 11/118* (2013.01); *B22D 41/00* (2013.01); *B22D 43/001* (2013.01)

(58) Field of Classification Search
CPC .... B22D 11/118; B22D 41/00; B22D 43/001; B22D 11/103
(Continued)

(56) References Cited

U.S. PATENT DOCUMENTS 3,549,061 A 12/1970 Plene
3,831,659 A * 8/1974 Gerding ..... B22D 11/118 164/488
(Continued)

FOREIGN PATENT DOCUMENTS

CN 102744393 * 10/2012 ..... B22D 41/00
CN 102744393 A 10/2012
(Continued)

OTHER PUBLICATIONS

Design of guide baffles in tundish and metallurgical effects analysis, Xu Changjun, Hu Xiaodong, Hu Lin, Wang Wei, Kuan Zongyu, Wang Xin, Chen Xingwei, Steelmaking (2013) 029, 001, 69-73.

*Primary Examiner* — Scott R Kastler
*Assistant Examiner* — Michael Aboagye
(74) *Attorney, Agent, or Firm* — Parthiban A. Mathavan

(57) ABSTRACT

A tundish with improved flow characteristics for molten metal has an outlet in its base. The outlet is spaced longitudinally in the tundish from a pour zone. The pour zone is positioned to receive a stream of molten steel from a ladle. The outlet is provided with a refractory barrier at its upper end. A portion of the floor of the tundish circumferential to the outlet is provided with a refractory structure having an interior free volume. Structures within the tundish, such as a dam extending upwardly from the tundish floor between the pour zone and the outlet, or a well in the tundish floor surrounding the outlet, may be used to affect the flow of molten metal in the tundish.

14 Claims, 12 Drawing Sheets

(51) Int. Cl.
*B22D 41/00* (2006.01)
*B22D 11/118* (2006.01)

(58) Field of Classification Search
USPC ..... 266/236, 227, 229, 275, 286; 222/591, 222/594
See application file for complete search history.

(56) References Cited

U.S. PATENT DOCUMENTS

| | | | | | |
|---|---|---|---|---|---|
| 4,043,543 | A | | 8/1977 | Courtenay et al. | |
| 4,739,972 | A | | 4/1988 | Podrini | |
| 4,754,800 | A | | 7/1988 | Jackson et al. | |
| 4,828,014 | A | | 5/1989 | Moscoe et al. | |
| 4,852,632 | A | * | 8/1989 | Jackson | B22D 11/10 164/437 |
| 5,169,591 | A | | 12/1992 | Schmidt et al. | |
| 5,348,275 | A | * | 9/1994 | Soofi | B22D 41/08 222/591 |
| 5,511,766 | A | * | 4/1996 | Vassilicos | B22D 11/11 266/78 |
| 5,662,823 | A | * | 9/1997 | Claar | B22D 41/003 222/594 |
| 5,882,577 | A | | 3/1999 | Zacharias | |
| 6,074,600 | A | | 6/2000 | Sver et al. | |
| 6,533,992 | B1 | | 3/2003 | Zacharias | |
| 6,929,775 | B2 | * | 8/2005 | Connors, Sr. | B22D 41/003 222/594 |
| 8,251,264 | B2 | | 8/2012 | Guillo et al. | |
| 8,631,978 | B2 | | 1/2014 | Guillo et al. | |
| 2004/0041312 | A1 | | 4/2004 | Connors | |

FOREIGN PATENT DOCUMENTS

| | | | | | |
|---|---|---|---|---|---|
| CN | 203956070 | | * | 11/2014 | B22D 41/00 |
| CN | 203956070 | U | | 11/2014 | |
| CN | 206622606 | U | | 11/2017 | |
| CN | 210160393 | U | | 3/2020 | |
| DE | 3827666 | A1 | | 2/1990 | |
| EP | 0481627 | B1 | | 4/1992 | |
| JP | S58154446 | A | | 9/1983 | |
| JP | 1986042458 | | | 2/1986 | |
| JP | 2003205360 | | | 1/2002 | |
| WO | 9506534 | A1 | | 3/1995 | |
| WO | 9700746 | A1 | | 1/1997 | |

* cited by examiner

CONFIGURED TUNDISH

CROSS-REFERENCE TO RELATED APPLICATIONS

This application is a U.S. national stage application, filed under 35 U.S.C. § 371, of International Application No. PCT/US2018/064002, which was filed on 5 Dec. 2018, and which claims priority to U.S. Application No. 62/609,239, filed 21 Dec. 2017, the contents of each of which are incorporated by reference in this specification.

BACKGROUND OF THE INVENTION

(1) Field of the Invention

This invention relates to a tundish and particularly to a configuration and means to improve or maintain the integrity of steel quality to the mold.

(2) Description of the Related Art

In the continuous casting of steel molten steel is poured from a ladle into an intermediate vessel, a tundish, and from the tundish into one or more continuous casting molds. For example, the tundish may feed two casting molds; i.e. it may be a two-strand tundish.

Unwanted inclusions can form in the steel while in the tundish through chemical interactions with non-steel elements. A variety of means have been proposed to improve or maintain the steel quality by preventing such inclusions from forming before the steel passes from the tundish to the mold. One of such means includes the use of a layer of 'active' flux on the surface of the molten steel in the tundish which prevents the interaction of steel with air. While the flux may be effective in preventing this interaction on the steel top surface, it does not prevent inclusions from forming below the surface.

Inside the tundish, refractory materials are typically used to line the tundish in several layers in order to safely contain the molten steel during the continuous casting process. The refractory lining is often porous or permeable and non-steel elements, such as gases, may enter the tundish through the refractory linings thereby forming oxide inclusions, e.g. alumina and iron oxides. Gases released from the heating of the refractory linings themselves may also interact with the molten steel to form unwanted inclusions. It is of particular importance to prevent the formation of inclusions near the nozzle or outlet of the tundish due to the reduced opportunity to remove inclusions in this volume.

One strategy to control the presence of inclusions in steel relies on the establishment of flow patterns within a vessel, and the consequent segregation of inclusions. Establishment of flow patterns of molten steel may be produced by various configurations of tundish furniture in the tundish.

Tundish furniture is a term used to describe any physical device within the interior space of the tundish used to aid in the continuous casting process. Tundish furniture is typically formed from refractory materials to withstand the high temperature and forces associated with molten steel.

A baffle is a device that may be placed in a tundish to divide the tundish into compartments, allowing the steel to pass through and blocking the transfer of slag from one compartment to another. A baffle may take the form of a refractory wall extending latitudinally from one longitudinal wall of the tundish to an opposite longitudinal wall. Typically, a baffle extends upward from the floor past the maximum steel height and has a multitude of holes or openings of any shape across the width of the baffle to allow steel to pass longitudinally from the pour region to the outlet.

A dam is a refractory piece that may be placed a in tundish to direct steel flow upwards towards the surface and to compartmentalize the tundish. Dams are used in tundishes to encourage the fluid to flow in a desired manner to enhance or maintain the cleanliness of steel during the continuous casting process as well as preventing the excessive loss of temperature before reaching the outlet during the first pouring of steel into an empty tundish.

A weir is a refractory device that may be placed in a tundish to compartmentalize the tundish and block the flow of slag from one compartment to another and allow the steel to flow under the weir. A weir may take the form of a refractory wall extending latitudinally from one longitudinal wall of the tundish to an opposite longitudinal wall, and having a bottom located above the level of the floor and a top extending above the maximum steel level. This creates an opening between the bottom of the baffle and the floor to allow steel to pass.

Impact pads are dense refractory shapes that may be used in a tundish to prevent the steel from eroding the bottom of the tundish due to the momentum of the incoming stream of molten steel.

A refractory barrier may be configured to extend upwards from the floor of a tundish and encompass the outlet nozzle. Such a refractory barrier acts to guide the bulk mass of molten steel from the upper and center region of the tundish into the outlet. Such a device may also be referred to as a refractory wall or a refractory diverter. The refractory barrier extends from the well floor in the upward direction and may be of any shape providing a continuous boundary around the tundish outlet. The walls of this device may be perpendicular to the floor of the tundish, or may be angled to form an annular conic section.

A tundish may be provided with a well: a portion of the tundish floor that is depressed with respect to the remainder of the tundish floor. Wells in tundishes, in particular at the outlet end, are designed and engineered to provide enhanced fluid flow characteristics during the continuous casting process such as improved draining, reduced unwanted regions of stagnant flow, and improved temperature homogeneity. At the end of casting during the final drain in the continuous casting process, wells can reduce the amount of steel left in the tundish due to pooling.

A need exists for the formation of a tundish internal configuration that produces a plurality of horizontal molten metal layers, having distinguishable properties, in the volume above the outlet nozzle, and for a consequent improvement in the quality of molten steel through the removal of inclusions.

BRIEF SUMMARY OF THE INVENTION

Accordingly, the present invention makes use of a novel combination of existing and novel tundish furniture that reduces contact of the main bulk of molten steel with the refractory lining so that the molten steel may flow into the mold without interacting with non-steel elements, thus reducing the formation of inclusions that could reduce the quality of steel.

The tundish of the invention is formed from a floor having an outlet, and side walls extending upwardly from the floor, and above the normal maximum operating level of molten steel in the tundish. A pour zone or pour volume is contained within the tundish and is horizontally displaced from the outlet. An impact surface may be positioned on the tundish floor beneath the pour zone or pour volume. A refractory barrier is disposed circumferentially around the upper end of the outlet. A refractory outlet periphery floor structure is disposed on the floor of the tundish and surrounding the outlet. The refractory outlet periphery floor structure has an upper surface and a lower surface. The refractory outlet periphery floor structure is configured to have an interior open volume open to the exterior of the structure.

The tundish of the invention contains at least one of the following floor structures in communication with the tundish floor:

(a) a well in the portion of floor of the tundish surrounding the outlet. The well has an upper surface and a depth.

(b) a dam positioned of the floor of the tundish between the impact surface and the outlet. The dam has a height.

The dam may extend upwardly, from the floor, a distance between 10% and 90%, between 20% and 80%, between 30% and 70%, or between 40% and 60% of the normal maximum operating level of steel in the tundish.

The dam may have at least one hole or opening therein allowing the passage of molten steel therethrough, so that molten steel may flow over said dam and through said at least one home or opening. In particular examples of the invention, the center of each hole or opening allowing the passage of steel therethrough is located at a position between 30% and 70% of the dam height.

The refractory outlet periphery floor structure may be selected from a group consisting of a mesh, a network, a lattice, a honeycomb, a grate and combinations thereof. The refractory outlet periphery floor structure may have an upper surface containing one or more openings having a hexagonal cross section in the plane of the upper surface of the refractory outlet periphery floor structure. The refractory outlet periphery floor structure may have an interior volume in the range from at least 20% to at most 80% of the total volume of the structure.

In certain examples of the invention, the interior open volume of the refractory outlet periphery floor structure consists of openings to the upper surface of the refractory outlet periphery floor structure in which the linear dimension of the openings in the vertical direction is at least 40% of the greatest linear dimension of the openings in the horizontal direction. In certain examples of the invention, the openings to the upper surface of the refractory outlet periphery floor structure have constrictions at the upper surface of the refractory outlet periphery floor structure. In certain examples of the invention, the refractory outlet periphery floor structure completely covers the well upper surface. The openings to the upper surface of the refractory outlet periphery floor structure may be circular or may take the form of a regular polygon, such as a square or a hexagon.

In certain examples of the invention, constrictions in the openings to the upper surface of the refractory outlet periphery floor structure have horizontal cross-sectional areas from and including 50% to and including 99% of the maximum horizontal cross-sectional area of the opening, have horizontal cross-sectional areas from and including 60% to and including 99% of the maximum horizontal cross-sectional area of the opening, have horizontal cross-sectional areas from and including 66% to and including 99% of the maximum horizontal cross-sectional area of the opening, have horizontal cross-sectional areas from and including 75% to and including 99% of the maximum horizontal cross-sectional area of the opening, have horizontal cross-sectional areas from and including 90% to and including 99% of the maximum horizontal cross-sectional area of the opening, or have horizontal cross-sectional areas from and including 95% to and including 99% of the maximum horizontal cross-sectional area of the opening.

In certain examples of the invention, the ratio of the surface area of the refractory outlet periphery floor structure in fluid communication with the tundish interior ($A_{fs}$) to the surface area of the portion of the tundish floor covered by the refractory outlet periphery floor structure ($A_r$) is equal to or greater than 1.1, or has a value from and including 1:1 (or 1) to and including 3:1 (or 3) wherein $A_r$ does not include area covered by the refractory barrier, or has a value from and including 1:1 (or 1) to and including 2:1 (or 2) wherein $A_r$ does not include area covered by the refractory barrier, or has a value from and including 1.2:1 (or 1.2) to and including 1.6:1 (or 1.6) wherein $A_r$ does not include area covered by the refractory barrier.

In certain examples of the invention, the ratio of the area of all openings in the upper surface of the refractory outlet periphery floor structure ($A_{up}$) to the area of the upper surface of the refractory outlet periphery floor structure ($A_u$) has a value from and including 0.1:1.0 (or 0.1) to and including 0.9:1.0, (or 0.9) or has a value from and including 0.2:1.0 (or 0.2) to and including 0.8:1.0 (or 0.8) or has a value from and including 0.3:1 (or 0.3) to and including 0.6:1 (or 0.6). The refractory outlet periphery floor structure may comprise a honeycomb. The openings to the upper surface of the refractory outlet periphery floor structure may comprise constrictions, in which the ratio $A_{fs}$ to $A_r$ may have a value from and including 1.2:1 (or 1.2) to and including 1.6:1 (or 1.6).

The invention is also directed to a process for the improvement in the quality of molten metal production, wherein molten metal is introduced into the pour zone or pour volume of a tundish as previously described, passed from the pour zone or pour volume to the outlet of the tundish as previously described, and withdrawn from the outlet of the tundish as previously described.

DETAILED DESCRIPTION OF THE INVENTION

Figure 1:
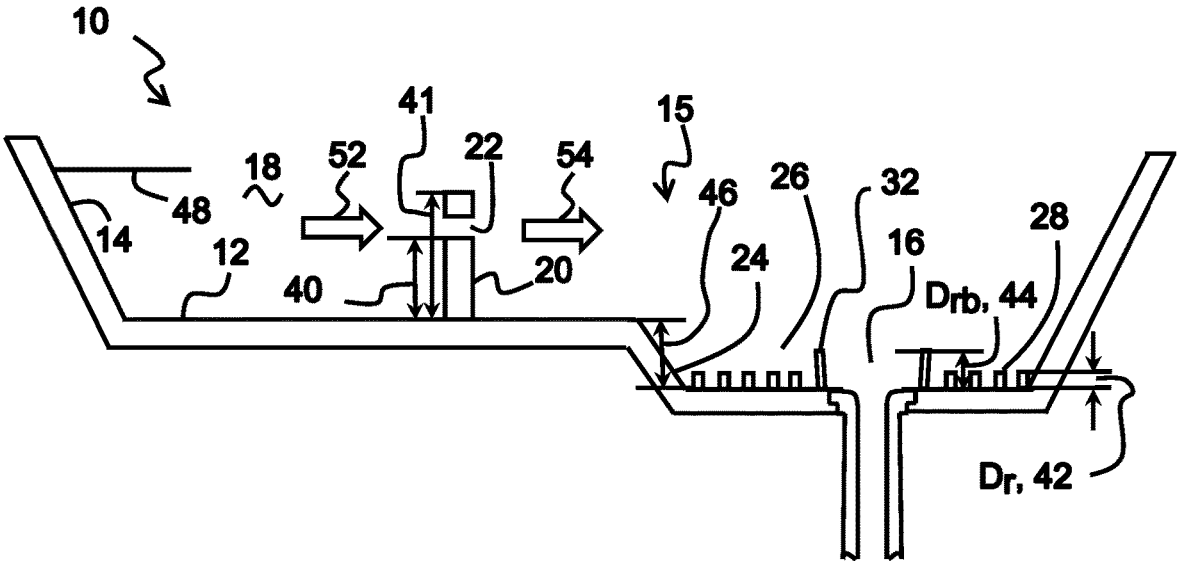
FIG. 1 is a cross-section of a tundish according to the invention.

FIG. 1 depicts a tundish 10 according to the present invention, having floor 12 from which walls 14 extend upwardly to define tundish interior volume 15. An outlet 16 extends downwardly through floor 12. Floor 12 has an upper surface directed towards the interior of tundish 10.

Steel is poured into tundish 10 by way of a pour volume 18 within the tundish, Pour volume 18 is horizontally displaced from outlet 16 to prevent direct flow from pour volume 18 to outlet 16.

Dam 20 extends upwardly from floor 12 between pour volume 18 and outlet 16. Dam opening 22 extends through dam 20 from the pour volume 18 towards outlet 16.

Well step 24 divides a sunken portion of floor 12 from the remainder of floor 12. Well 26 is the resulting sunken portion of floor 12. In the depicted example of the invention, outlet 16 is located within well 26. The upwardly-facing surface of well 26 is covered by refractory outlet periphery floor structure 28.

Refractory barrier 32 is disposed circumferentially around the upper end of outlet 16.

Dam opening height 40 represents the distance from the upper surface of floor 12 to the lowest portion of dam opening 22. Dam height 41 represents the distance from the upper surface of floor 12 to the upper surface of dam 20.

Refractory outlet periphery floor structure height 42 represents the distance from the bottom or lower surface of refractory outlet periphery floor structure 28 to the upper surface of refractory outlet periphery floor structure 28.

Refractory barrier height 44 represents the distance from the upper surface of well 26 to the upper surface of refractory barrier 32.

Well depth 46 represents the distance between the upper surface of well 26 to the upper surface of floor 12.

Maximum bath height of steel 48 represents the upper surface of molten steel in the tundish when tundish 10 contains the maximum volume of molten metal that the tundish was designed to accommodate during normal operation.

Pour volume flow direction 52 represents the general direction of flow from pour volume 18 towards dam 20.

Direction of flow from dam 54 represents the general direction of flow after passing through or over dam 20.

In operation, molten metal is introduced into tundish 10 downwardly into pour volume 18. The tundish may be provided with an impact pad (not shown) on floor 12 directly below the flow of molten metal being introduced to the tundish. The molten metal then passes around, through or over dam 20 into the volume of the tundish containing outlet 16. The molten metal fills, sequentially, the volume of the refractory outlet periphery floor structure having height 42, the volume of well 26 below refractory barrier height 44, and the volume of well 26 above refractory barrier height 44. Above the volume of the well, the next volumes to receive flow are the volume of the well having an upper limit of the dam opening height 40, and the volume of the well having an upper limit of the dam height 41. On the opening of outlet 16, molten metal passes out of tundish 10.

The tundish is a refractory lined vessel or container having floor surfaces, sidewalls along the perimeter of the floor that extend upwardly from the floor, and an open top. The sidewalls may be perpendicular to the floor, or may form an angle greater than 90 degrees with the floor. The floor may be a single planar surface or made up of multiple surfaces offset from one another in the vertical direction to create tiers. The tundish has a longitudinal direction extending from an end containing the pour volume, and an opposite end containing the outlet. The tundish also has a latitudinal direction at a right angle to the longitudinal direction.

Dam 20 is located between the end containing the pour volume and the opposite end containing the outlet, and has a major surface facing the pour volume and a major surface facing the end of the tundish containing the outlet. The major surfaces of the dam may be planar, or may be planar without surface detail. The dam may extend latitudinally from one longitudinal wall of the tundish to an opposite wall. It may be configured to be in contact with two opposing longitudinal walls for its entire height, or it may diverge from the two opposing longitudinal walls at some height beneath its maximum height. It may house one or more dam openings passing between its two major surfaces. In certain examples of the invention, the dam has a height equal to a value from and including 40% to and including 60% of the height of the normal maximum level of steel in the tundish. Examples of designs of dams for use in refractory vessels of the present invention may divert flow away from the floor at the outlet region to prevent stagnant regions in the upper portions of the tundish, and may reduce extreme changes in flow pattern as incoming steel temperatures change; these extreme changes in flow pattern would change the density of the molten metal in different parts of the tundish.

Each dam may have a hole or opening, or multiple holes or openings, spaced across its width; the holes or openings are advantageously positioned above the tundish floor with the distance from the floor to the closest edge of the hole or opening being from 25 mm to 50% of the height of the dam. The holes or openings may be of circular cross-section, i.e. the passageways through the dam are cylindrical, although this is not essential, and they may be, for example, of elliptical or other shape.

The holes or openings may extend horizontally through the dam, or they may be angled upwardly, e.g. at an angle of from 15 degrees to 75 degrees to the horizontal from the pour zone side or pour volume side to the outlet side of the dam. In this instance, the heights of the hole centers or opening centers referred to above are measured on the upstream, i.e. impact pad side, of the dam.

The holes or openings may be, for example, of 5 to 15 cm in diameter for a dam across the full width of tundish, the dam being of height 40 cm and the tundish having a steel working level of 80 cm.

Holes or openings through the dam may represent from and including 1% to and including 50% of the area of the dam face, from and including 1% to and including 40% of the area of the dam face, from and including 5% to and including 50% of the area of the dam face, from and including 5% to and including 40% of the area of the dam face, from and including 10% to and including 50% of the area of the dam face, from and including 10% to and including 40% of the area of the dam face, from and including 1% to and including 20% of the area of the dam face, from and including 1% to and including 10% of the area of the dam face, and from and including 1% to and including 5% of the area of the dam face.

Outlet periphery floor structure 28 contains partially enclosed volumes that are in communication with tundish interior volume 15. The floor structure is constructed from a refractory material. Outlet periphery floor structure 28 may take the form of a grid, mesh, lattice, honeycomb, or other repeating pattern or a reticulated structure, and may incorporate offset layers, a plurality of layers with different geometries, or constrictions of the partially enclosed volumes at their upper surfaces. The partially enclosed volumes of outlet periphery floor structure 28 may also contain constrictions at locations between the structure's upper and lower surfaces. The geometric pattern of outlet periphery floor structure 28 may repeat radially from the nozzle center or in the latitudinal and/or longitudinal direction. The horizontal geometric profile may include polygons of any number of sides including squares, rectangles, hexagons and octagons, circles of uniform radius, ovals with multiple radii, or irregular shapes repeating consistently or forming a pattern that is repeated.

Outlet periphery floor structure 28 may partially surround, or may completely surround, outlet 16. The partially enclosed volumes may represent from and including 10% to and including 90%, from and including 40% to and including 90%, or from and including 50% to and including 90% of the total volume of outlet periphery floor structure 28. Reduced ratios of partially enclosed volumes to total volume limit the effect of constraining molten metal within the outlet periphery floor structure; ratios of partially enclosed volumes to total volume approaching unity would only be achievable by thinning the walls of floor structure 28 to thicknesses that would compromise the structural integrity of floor structure 28.

The cavities, or partially enclosed volumes, of outlet periphery floor structure 28 may be in the form of a single shape projected in the vertical direction, or may have a plurality of shapes expressed in the horizontal plane in a plurality of horizontal layers.

Partially enclosed volumes in the outlet periphery floor structure 28 may have a vertical height equal to or greater than 30%, equal to or greater than 40%, or equal to or greater than 50% of their horizontal width.

Refractory barrier 32 may take the form of a continuous annular structure, and is circumferentially disposed around outlet 16. Refractory barrier 32 may have a height greater than the height of outlet periphery floor structure 42, and may have a height greater than the depth of well 26. The barrier may have walls perpendicular to tundish floor 12, or the walls may be canted inwards. The walls may be of uniform or varied height. The horizontal diameter of refractory barrier 32 may have a value from and including 100% to and including 300% of the horizontal diameter of outlet 16.

Figure 2:
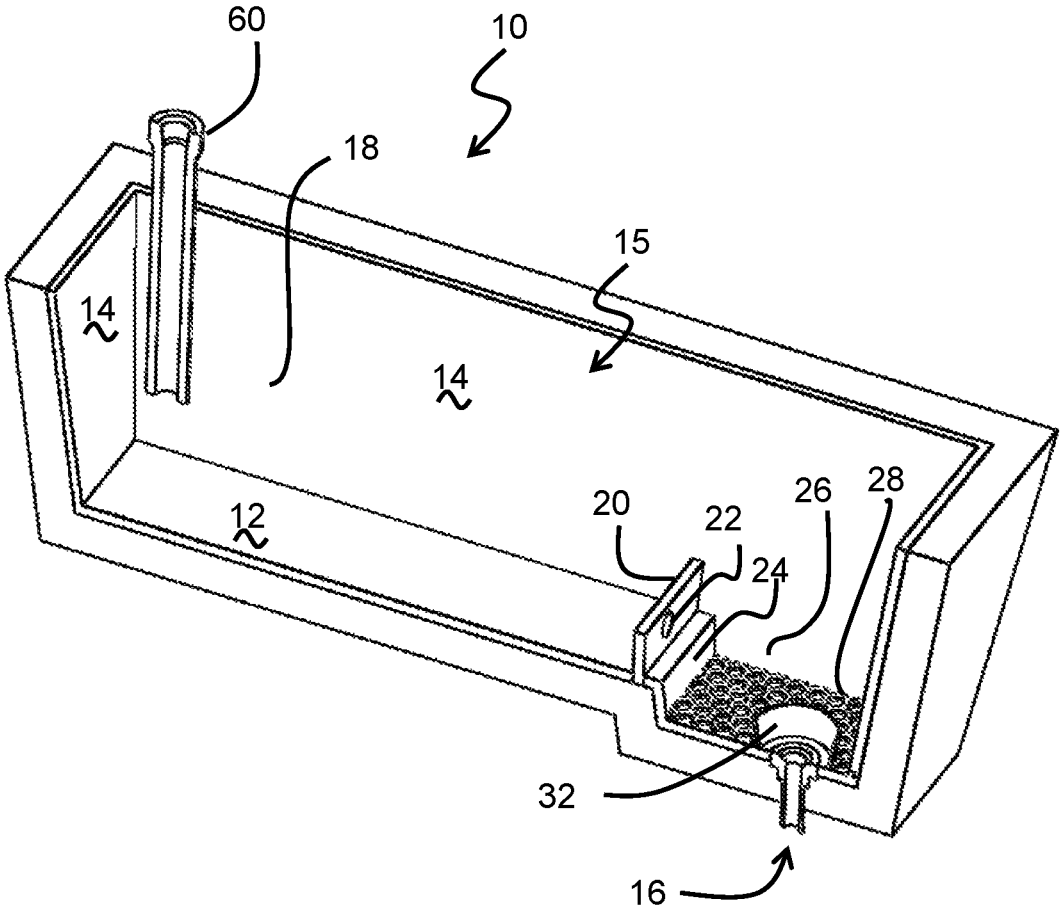
FIG. 2 is a perspective view of a cross-section of a tundish according to the invention.

FIG. 2 is a perspective cutaway representation of a tundish 10 containing an internal configuration according to the invention. Tundish 10 is provided with a floor 12 from which walls 14 extend upwardly to define tundish interior volume 15. An outlet 16 extends downwardly through floor 12.

Steel is poured into tundish 10 by way of a pour nozzle 60 into pour volume 18 within the tundish, Pour volume 18 is horizontally displaced from outlet 16 to prevent direct flow from pour volume 18 to outlet 16.

Dam 20 extends upwardly from floor 12 between pour volume 18 and outlet 16. Dam opening 22 extends through dam 20 from the pour volume 18 towards outlet 16.

Well step 24 divides a sunken portion of floor 12 from the remainder of floor 12. Well 26 is the resulting sunken portion of floor 12. In the depicted example of the invention, outlet 16 is located within well 26. The upwardly-facing surface of well 26 is covered by refractory outlet periphery floor structure 28.

Refractory barrier 32 is disposed circumferentially around the upper end of outlet 16.

Figure 3:
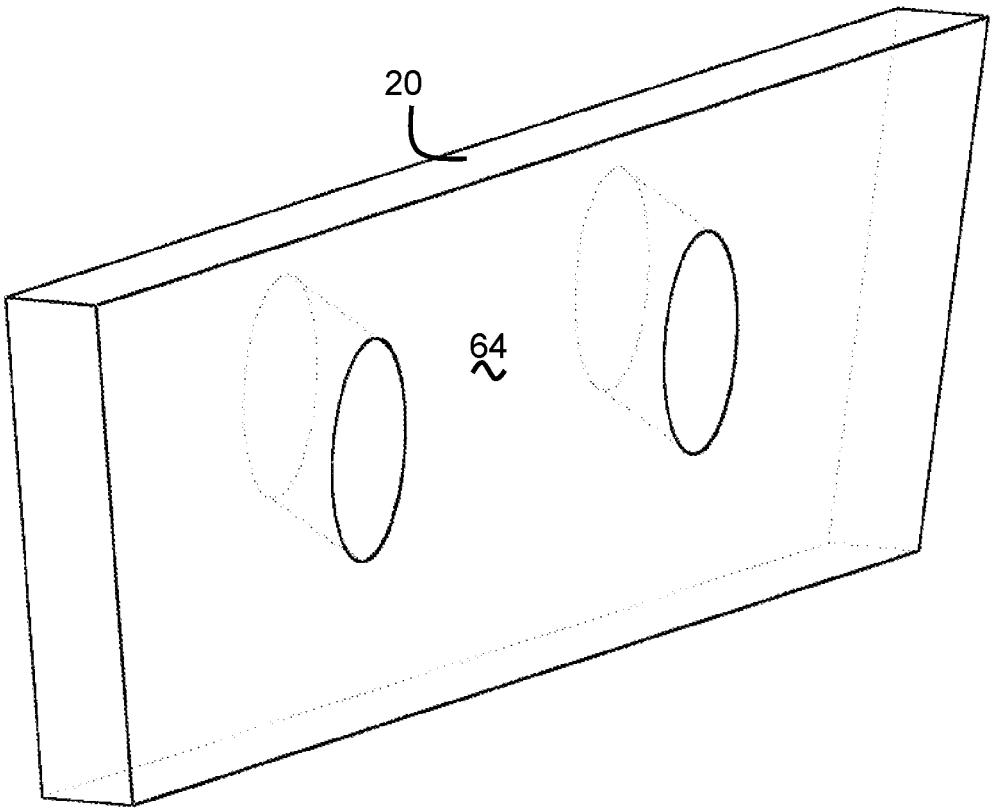
FIG. 3 is perspective view of a dam used in a tundish according to the invention.

FIG. 3 is a perspective representation of a dam 20 in a tundish according to the invention, having a pair of parallel opposed dam faces 64. Each of a pair of dam openings 22 passes through the dam from one of the pair of parallel opposed faces to the other of the pair of parallel opposed faces. The longitudinal axes of the dam openings may be perpendicular to all lines in a dam face 64 or, as shown in FIG. 3, may have a nonperpendicular angle with respect to a dam face 64.

Figure 4:
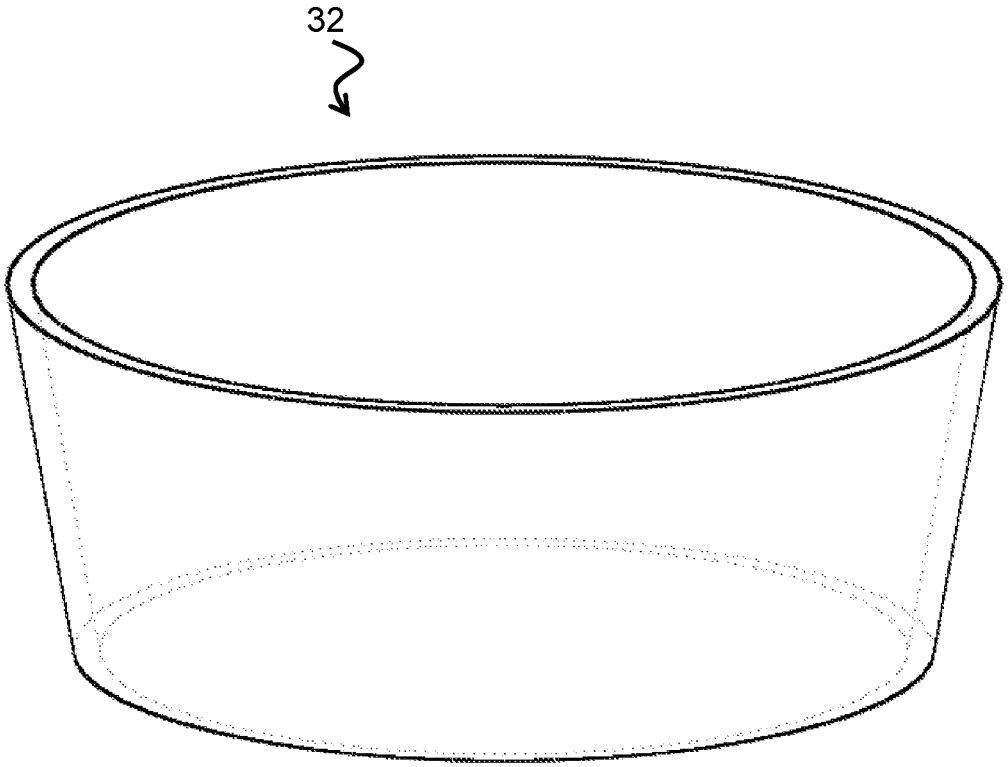
FIG. 4 is a perspective view of a refractory barrier according to the invention.

FIG. 4 is an elevation of a refractory barrier 32 in a tundish according to the invention. The refractory barrier 32 depicted takes the form of a hollow conical frustum being open at each longitudinal end (the longitudinal ends being a bottom end and a top end, as the refractory barrier is installed in the tundish) and having a wall of uniform thickness. The refractory barrier 32 depicted has a bottom end with a smaller radius than the top end has.

Figure 5:
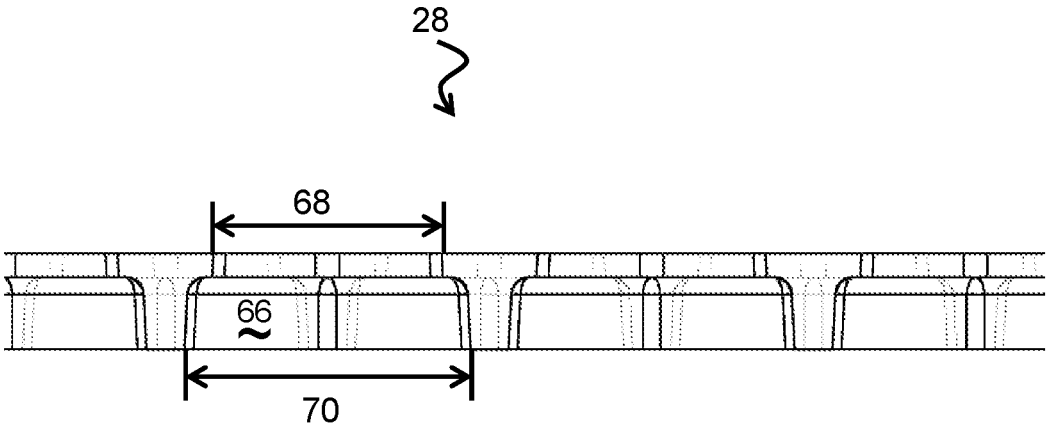
FIG. 5 is a view of a vertical cross-section of refractory outlet periphery floor structure according to the invention.

FIG. 5 is a depiction of a vertical cross-section of a refractory outlet periphery floor structure 28. Floor structure 28 contains individual cells 66 of the refractory outlet periphery floor structure, having hexagonal horizontal cross-sections. Top openings to individual cells 66 are constricted; FIG. 5 depicts the minimum horizontal dimension of the cell constriction 68, occurring here at the upper end of the cell, and the maximum horizontal dimension of the cell interior 70, occurring here at the lower end of the cell.

Figure 6:
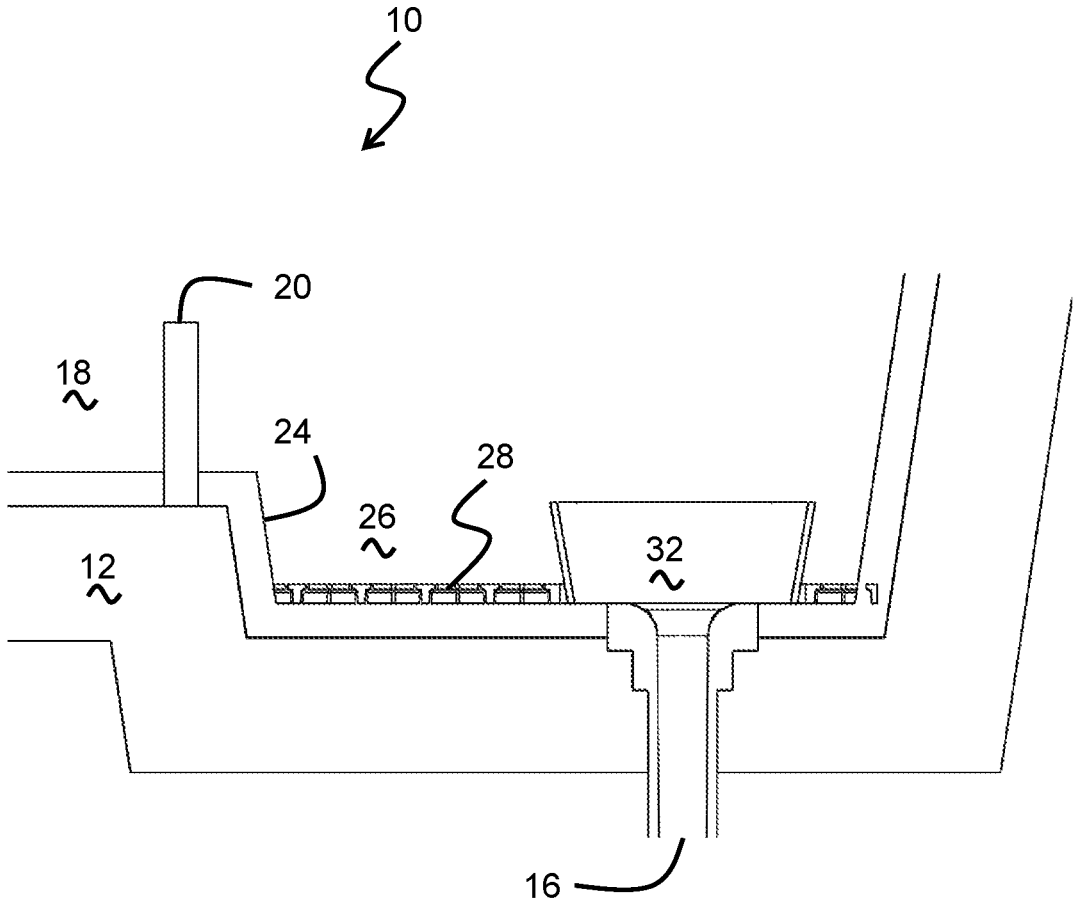
FIG. 6 is a longitudinal cross section of a portion of the floor of a tundish according to the invention.

FIG. 6 is a depiction, in vertical cross-section, of the portion of a tundish 10 surrounding tundish outlet 16. Dam 20 extends upwardly from floor 12 between pour volume 18 and outlet 16.

Well step 24 divides a sunken portion of floor 12 from the remainder of floor 12. Well 26 is the resulting sunken portion of floor 12. In the depicted example of the invention, outlet 16 is located within well 26. The upwardly-facing surface of well 26 is covered by refractory outlet periphery floor structure 28.

Refractory barrier 32 is disposed circumferentially around the upper end of outlet 16.

Figure 7:
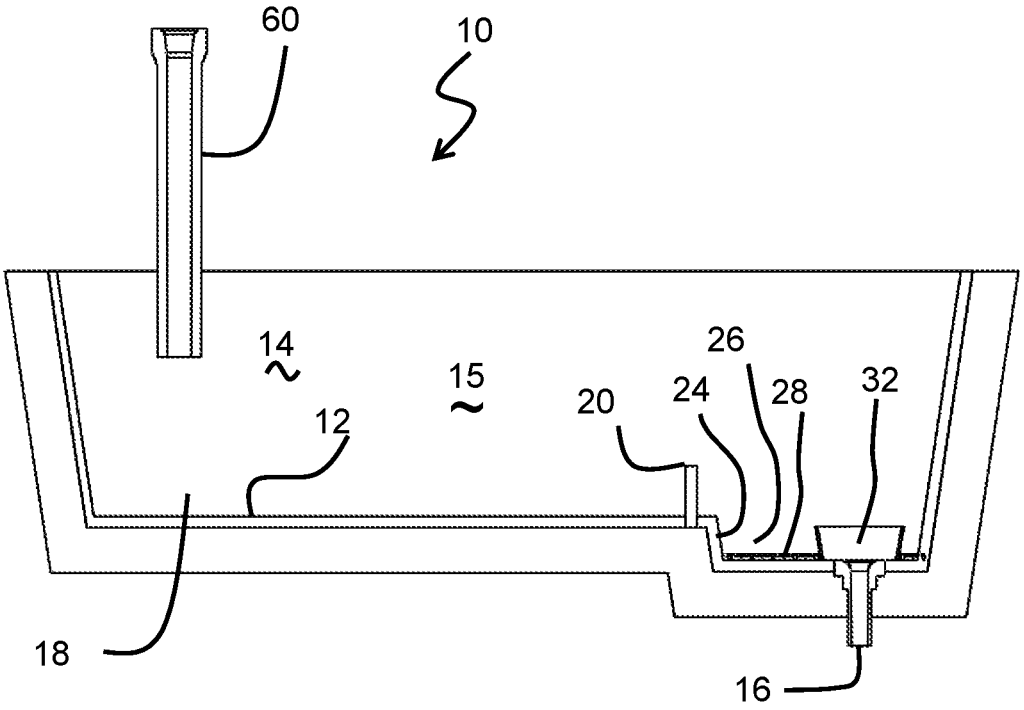
FIG. 7 is a cross-section of a tundish according to the invention.

FIG. 7 is a vertical cross-section of a tundish 10 according to the present invention, having floor 12 from which walls 14 extend upwardly to define tundish interior volume 15. An outlet 16 extends downwardly through floor 12.

Steel is poured into tundish 10 through tundish pour nozzle 60 into a pour volume 18 within the tundish. Pour volume 18 is horizontally displaced from outlet 16 to prevent direct flow from pour volume 18 to outlet 16.

Dam 20 extends upwardly from floor 12 between pour volume 18 and outlet 16.

Well step 24 divides a sunken portion of floor 12 from the remainder of floor 12. Well 26 is the resulting sunken portion of floor 12. In the depicted example of the invention, outlet 16 is located within well 26. The upwardly-facing surface of well 26 is covered by refractory outlet periphery floor structure 28.

Refractory barrier 32 is disposed circumferentially around the upper end of outlet 16.

Figure 8A:
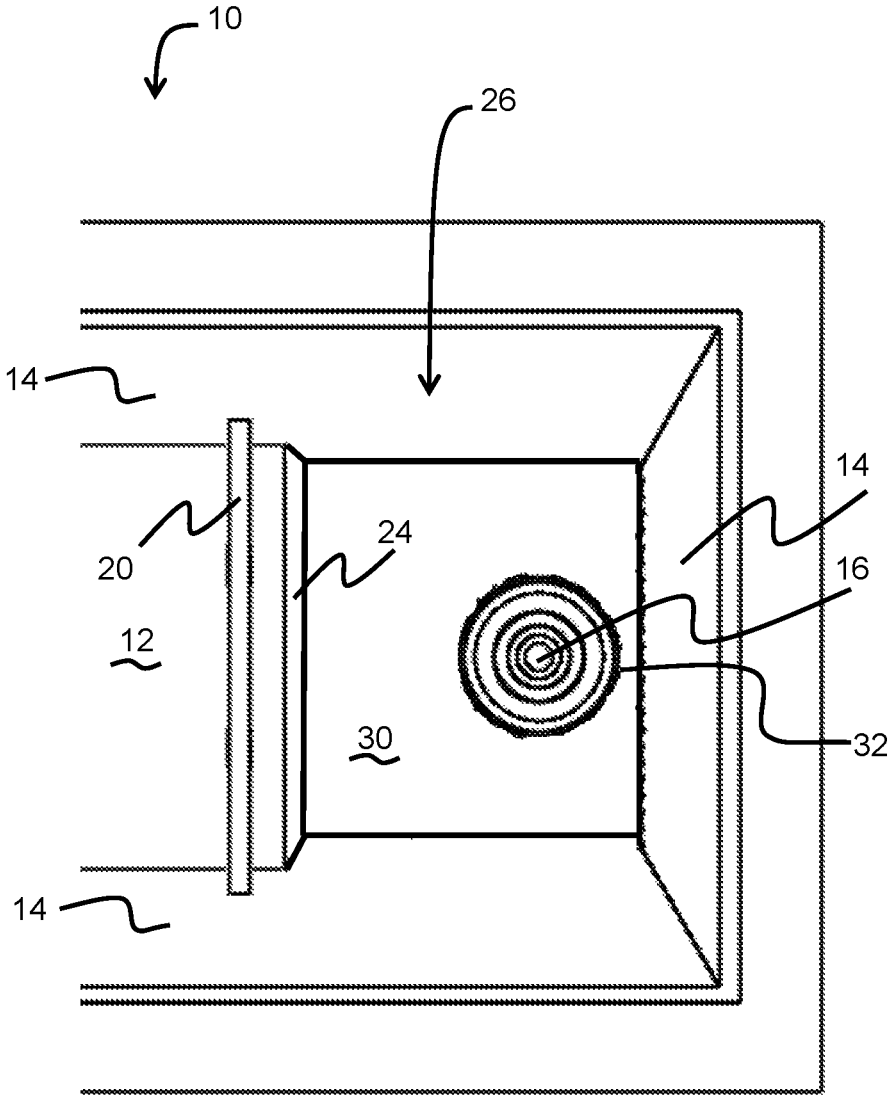
FIG. 8*a* is a top view of a portion of a tundish according to the invention.
Figure 8B:
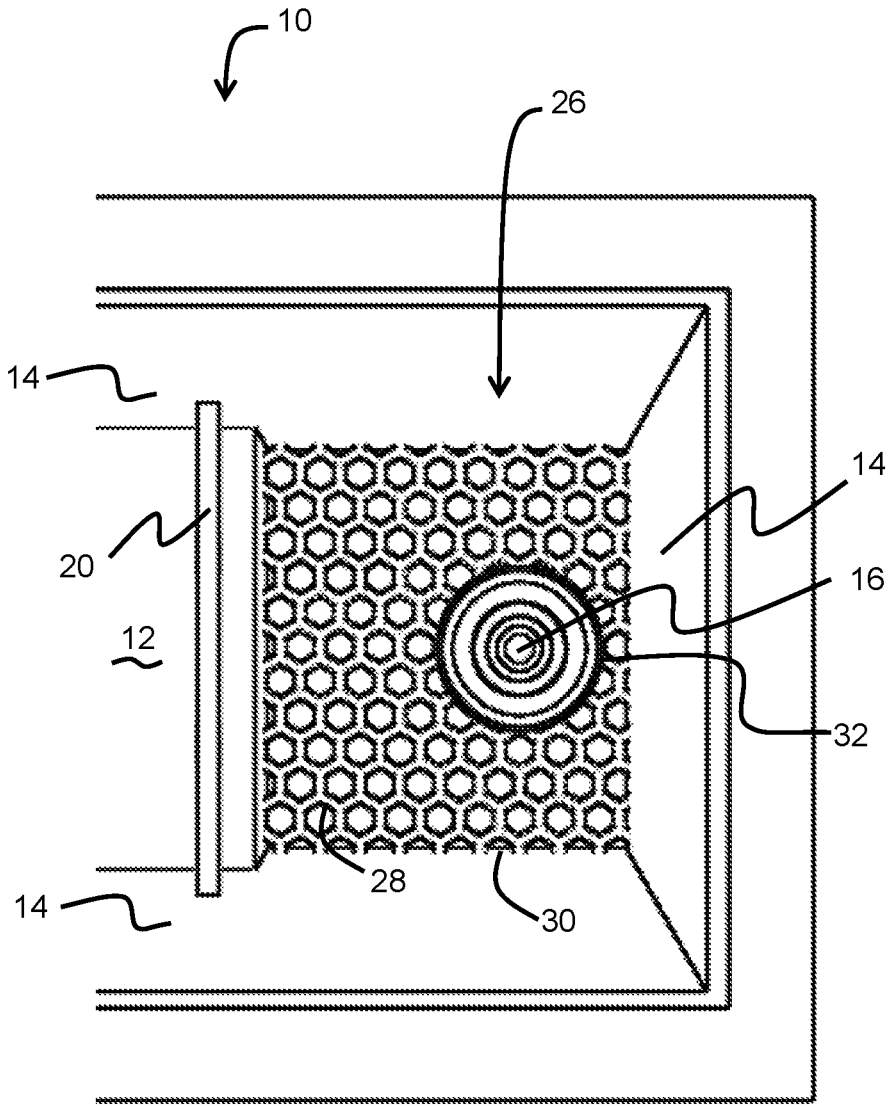
FIG. 8*b* is a top view of a tundish according to the invention.
Figure 9A:
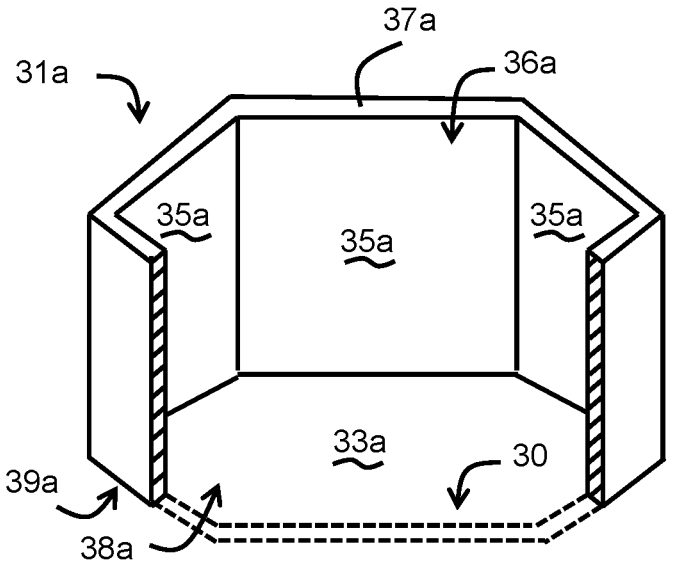
FIG. 9*a* is an elevation of a section of an individual cell of the refractory outlet periphery floor structure 28.
Figure 9B:
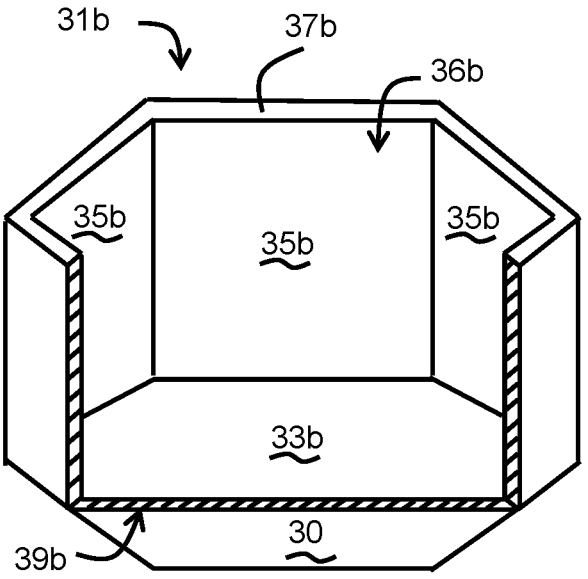
FIG. 9*b* is an elevation of a section of an individual cell of the refractory outlet periphery floor structure 28.

FIG. 8*a* is a top view of a portion of a tundish. FIG. 8*b* is a top view of a tundish according to the invention. FIG. 9*a* is an elevation of a section of an individual cell of the refractory outlet periphery floor structure 28. FIG. 9*b* is an elevation of a section of an individual cell of the refractory outlet periphery floor structure 28.

The refractory outlet periphery floor structure may have a contact area ratio greater than or equal to X. As used herein, the term "contact area ratio" means the ratio of the surface area of the refractory outlet periphery floor structure in contact with molten metal during use ($A_{fs}$) to the surface area of the portion of the tundish floor, or the portion of the well floor, covered by the refractory outlet periphery floor structure ($A_r$).

$$A_{fs}/A_r \geq X$$

The contact area ratio X may have values from and including 1.1 to and including 100, from and including 1.3 to and including 100, from and including 1.4 to and including 100, from and including 1.1 to and including 50, from and including 1.3 to and including 50, from and including 1.4 to and including 50, from and including 1.1 to and including 20, from and including 1.3 to and including 20, from and including 1.4 to and including 20, from and including 1.1 to and including 10, from and including 1.3 to and including 10, and from and including 1.4 to and including 10. The refractory outlet periphery floor structure may contain cells that are open at their upper ends. The cells may be constricted or unconstructed at their upper ends. The cells may be horizontally aligned, and may have longitudinal axes that are horizontal. The refractory outlet periphery floor structure may have a reticulated or network structure.

By way of example, referring to FIG. 8*a*, a well 26 of a tundish 10 includes an outlet 16 located through the floor 30 of the well 26. Dam 20 extends upwardly from floor 12. The well floor 30 comprises the upwardly-facing surface of the well 26 and intersects the interior surfaces of the tundish walls 14 and the interior surface of the well step 24. A refractory barrier 32 is located circumferentially around an upper portion of the outlet 16 and extends upwardly from the well floor 30. The surface area ($A_f$) of the well floor 30 is equal to the rectangular surface area delimited by the intersections of the well floor 30 with the tundish walls 14 and well step 24, minus the circular surface area delimited by the refractory barrier 32. The surface area ($A_f$) of the well floor 30 does not include any area of the tundish walls 14 or well step 24.

Referring to FIG. 8*b*, a well 26 of a tundish 10 includes an outlet 16 located through the floor 30 of the well 26. Dam 20 extends upwardly from floor 12. The well floor 30 comprises the upwardly-facing surface of the well 26 and intersects the interior surfaces of the tundish walls 14. A refractory outlet periphery floor structure 28 is positioned in the well 26 and is located over and covers the well floor 30 around the refractory barrier 32. The refractory outlet periphery floor structure 28 shown in FIG. 8*b* comprises a hexagonal honeycomb pattern. However, it is understood that the refractory outlet periphery floor structure 28 could comprise any morphology having an interior open volume that is in fluid communication with the exterior of the structure to allow for the infiltration and retention of molten metal (e.g., tessellated regular or irregular polygonal patterns or other symmetrical or asymmetrical grid patterns, with or without constrictions located at the top of individual cells comprising the refractory outlet periphery floor structure 28). During use, when molten metal is introduced into the tundish well 26, the molten metal will flow into and fill the plurality of hexagonal-shaped (or other shaped) cells comprising the refractory outlet periphery floor structure 28.

Referring to FIG. 9*a*, an individual cell 31*a* of the refractory outlet periphery floor structure comprises interior side walls 35*a* and an interior bottom surface 33*a*. In the implementation shown in FIG. 9*a*, the cells 31*a* comprising the refractory outlet periphery floor structure each comprise upper openings 36*a* through an upper surface 37*a* of the refractory outlet periphery floor structure, and lower openings 38*a* through a lower surface 39*a* of the refractory outlet periphery floor structure. The interior open volume of the refractory outlet periphery floor structure corresponds to the plurality of hexagonal-shaped through openings that form the hexagonal-shaped cells 31*a*. Because of the lower openings 38*a* through the lower surface 39*a* of the refractory outlet periphery floor structure, the interior bottom surface 33*a* of the cells 31*a* corresponds to the portion of the well floor 30 that underlies the refractory outlet periphery floor structure that is not in contact with the lower surface 39*a*.

Referring to FIG. 9*b*, the interior bottom surface 33*b* of the cells 31*b* may be integrally formed with the side walls 35*b* such that no lower openings extend through the lower surface 39*b* of the refractory outlet periphery floor structure. In the implementation shown in FIG. 9*b*, the cells 31*b* comprising the refractory outlet periphery floor structure each comprise upper openings 36*b* through the upper surface 37*b* of the refractory outlet periphery floor structure, and the interior open volume of the refractory outlet periphery floor structure corresponds to the plurality of hexagonal-shaped blind openings that form the hexagonal-shaped cells 31*b*. Although hexagonal-shaped cells 31*a/b* are shown in FIGS. 9*a* and 9*b*, again, it is understood that the plurality of cells comprising the refractory outlet periphery floor structure could independently comprise any morphology having an interior open volume that is in fluid communication with the exterior of the refractory outlet periphery floor structure to allow for the infiltration and retention of molten metal.

The refractory outlet periphery floor structure has a surface area ($A_{fs}$) that contacts molten metal when introduced into the tundish 10 during use. The molten metal contained within the refractory outlet periphery floor structure will contact the surfaces of the cell walls and the cell floor. Referring again to FIGS. 9*a* and 9*b*, the molten metal will contact the side walls 35*a/b* and the interior bottom surfaces 33*a/b* of the cells 31*a/b*. Accordingly, the surface area ($A_{fs}$) of the refractory outlet periphery floor structure in contact with molten metal during use includes the total surface area of the side walls 35*a/b* and the interior bottom surfaces 33*a/b* of the plurality of constituent cells 31*a/b*. The contact surface area ($A_{fs}$) does not include the surface area of the upper surface 37*a/b* of the refractory outlet periphery floor structure surrounding the upper openings 36*a/b* because the upper surface 37*a/b* is located outside the interior open volume of the refractory outlet periphery floor structure. In implementations comprising constrictions or other structures (not shown) located at the upper openings 36*a/b* or otherwise located within the plurality of constituent cells 31*a/b*, the contact surface area ($A_{fs}$) includes the surface area of such structures located inside the interior open volume of the refractory outlet periphery floor structure.

The refractory outlet periphery floor structure may have a contact area ratio greater than or equal to X ($A_{fs}/A_f \geq X$). Described differently, the surface area of the refractory outlet periphery floor structure in contact with molten metal during use may be greater than or equal to the surface area of the portion of the well floor 30 covered by the refractory outlet periphery floor structure multiplied by a factor of X ($A_{fs} \geq A_f * X$). The contact area ratio may be greater than or equal to 1.05. 1.1, 1.15, 1.2, 1.25, 1.3, 1.35, 1.5, 2, 3, 4, 5, 6, 7, 8, 9, 10, 20, or 50.

Although the implementations shown in FIGS. 8*a* and 8*b* comprise the refractory outlet periphery floor structure located within the well 26, it is understood that a refractory outlet periphery floor structure, as described herein, can be located around an outlet in a tundish that does not comprise an offset well containing the outlet. In such implementations, the outlet periphery floor structure can be located on the tundish floor, and the contact area ratio is calculated by dividing the surface area of the refractory outlet periphery floor structure in contact with molten metal during use ($A_{fs}$) by the surface area of the portion of the tundish floor covered by the refractory outlet periphery floor structure ($A_f$).

Figure 10:
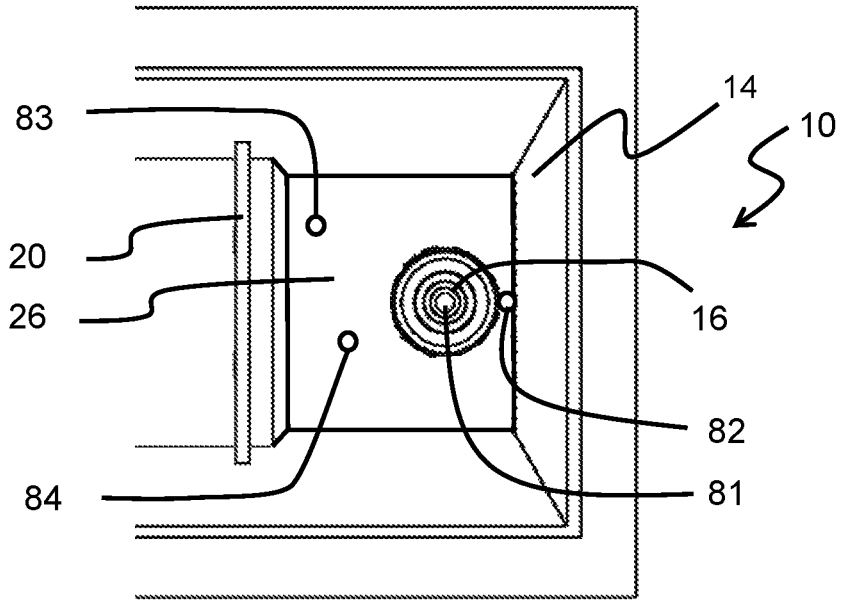
FIG. 10 is a top view of a portion of a tundish according to the invention.

FIG. 10 is a top view of a portion of a tundish 10. A first thermocouple 81 is located in tundish flow outlet 16. A second thermocouple 82 is located on the floor of well 26 between tundish flow outlet 16 and the tundish wall 14 disposed on the opposite side of well 26 with respect to dam 20. A third thermocouple 83 is located within well 26 between tundish flow outlet 16 and dam 20. A fourth thermocouple 84 is located within well 26 between tundish flow outlet 16 and dam 20. Second, third and fourth thermocouples are located within cavities in the outlet periphery floor structure (not shown). Fourth thermocouple 84 is located closer to tundish flow outlet 16 than is third thermocouple 83. Fourth thermocouple 84 is located closer to the longitudinal vertical central plane of tundish 10 than is third thermocouple 83.

Figure 11:
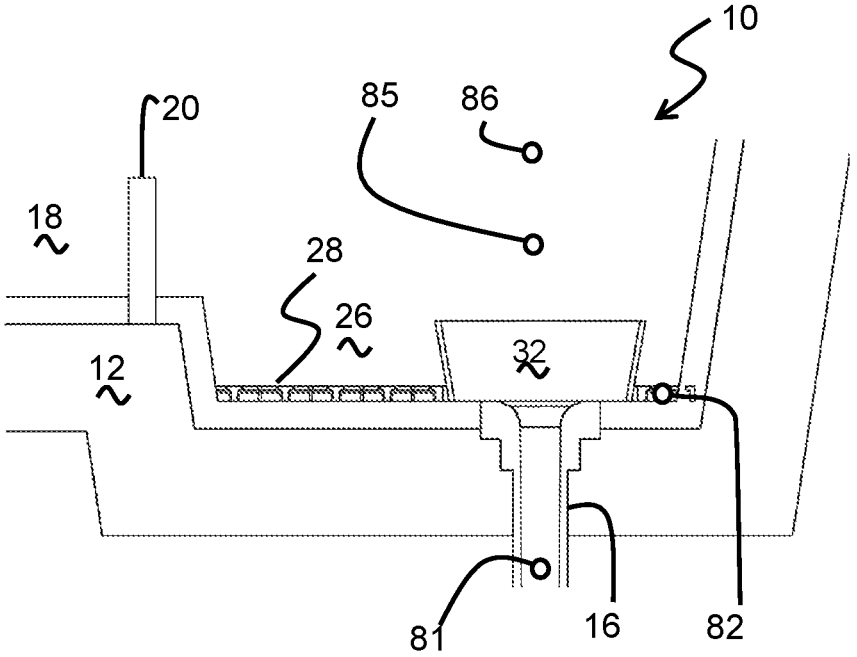
FIG. 11 is a cross-section of a tundish according to the invention.

FIG. 11 is a depiction, in vertical cross-section, of the portion of a tundish 10 surrounding tundish outlet 16. Dam 20 extends upwardly from floor 12 between pour volume 18 and outlet 16. The upwardly-facing bottom surface of well 26 is covered by refractory outlet periphery floor structure 28.

Refractory barrier 32 is disposed circumferentially around the upper end of outlet 16. Second thermocouple 82 is located on the floor of well 26 between tundish flow outlet 16 and the tundish wall 14 disclosed on the opposite side of well 26 with respect to dam 20.

First thermocouple 81 is located in tundish flow outlet 16. Second thermocouple 82 is located on the floor of well 26 between tundish flow outlet 16 and the tundish wall 14 disposed on the opposite side of well 26 with respect to dam 20. A fifth thermocouple 85 is located above outlet 16, at a height above the upper surface of floor 12 and below the height of the top of dam 20. A sixth thermocouple 86 is located above outlet 16, at a height above the top of dam 20.

Figure 12:
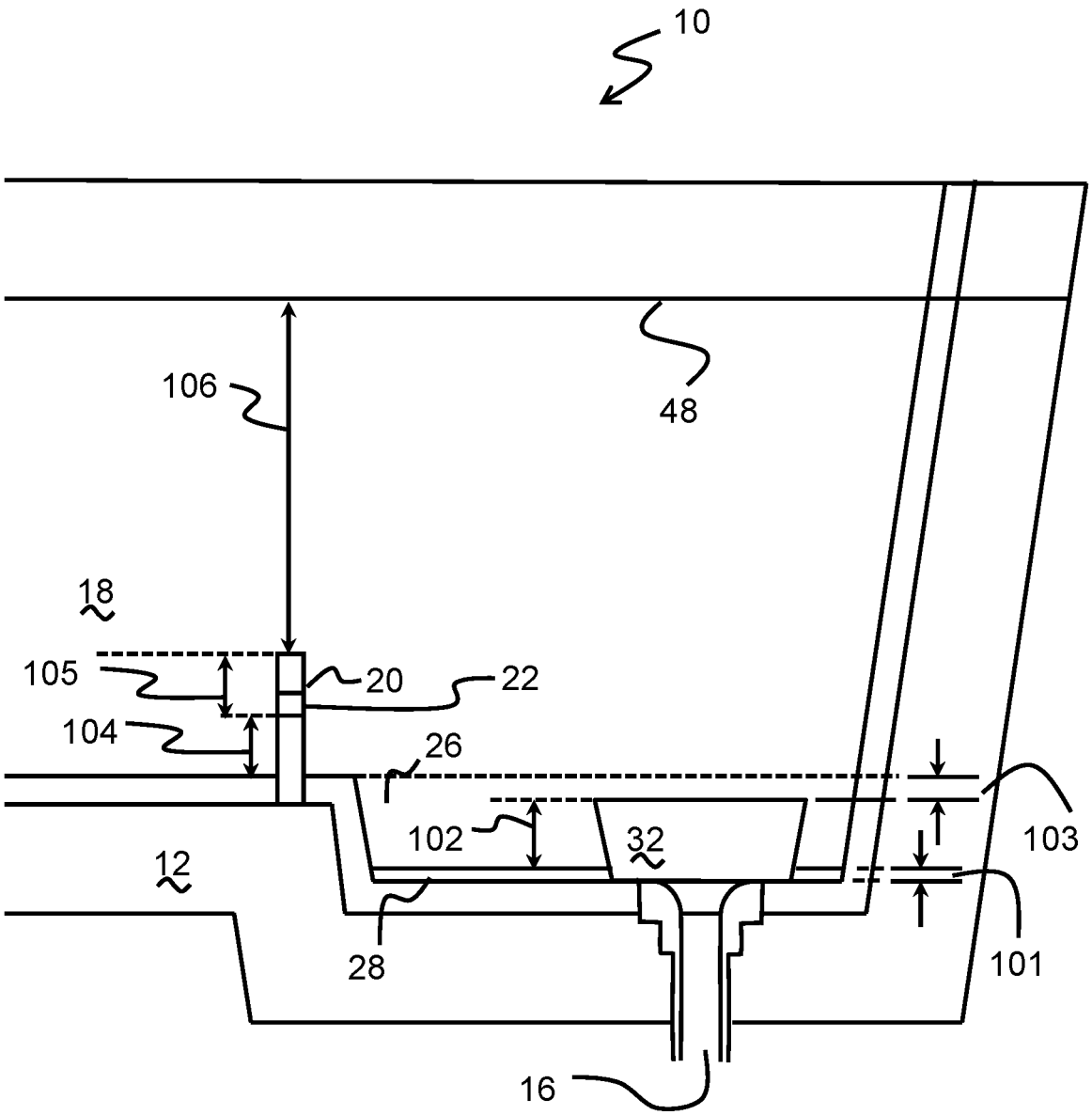
FIG. 12 is a cross-section of a tundish according to the invention.

FIG. 12 is a depiction, in vertical cross-section, of the portion of a tundish 10 surrounding tundish outlet 16. Dam 20 extends upwardly from floor 12 between pour volume 18 and outlet 16. The upper face of the bottom surface of well 26 is covered by refractory outlet periphery floor structure 28.

Refractory barrier 32 is disposed circumferentially around the upper end of outlet 16.

Maximum bath height of steel 48 represents the upper surface of molten steel in the tundish when tundish 10 contains the maximum volume of molten metal that the tundish was designed to accommodate during normal operation.

The volume of tundish 10 is shown as containing a plurality of layers that, as a result of the geometry of the interior of the tundish, may each be expected to possess a characteristic flow pattern.

Layer A (101) corresponds to the vertical dimension 42 of outlet periphery floor structure 28. Layer A extends from the upper face of well 26 to the upper face of refractory outlet periphery floor structure 28.

Layer B (102) extends from the upper face of refractory outlet periphery floor structure 28 to the horizontal plane containing the upper extent of refractory barrier 32.

Layer C (103) extends from the horizontal plane containing the upper extent of refractory barrier 32 to the horizontal plane containing the upper extent of well 26.

Layer D (104) extends from the horizontal plane containing the upper extent of well 26 to the horizontal plane of the lowest extent of dam opening 22 in dam 20.

Layer E (105) extends from the horizontal plane of the lowest extent of dam opening 22 in dam 20 to the horizontal plane of the upper extent of dam 20.

Layer F (106) extends from the horizontal plane of the upper extent of dam 20 to the maximum bath height of steel 48.

The total working volume of the tundish is defined as the volume bounded below by the floor of well 26 and above by the maximum bath height of steel 48, and encompasses layers A, B, C, D, E and F. The vertical dimension of the total working volume of the tundish is the vertical distance between the floor of well 26 and the maximum bath height of steel 48.

EXAMPLE I

Experiments and testing using physical water modeling techniques show the presence of distinct layers distinguished by differences in temperature over time through simulations of real world casting procedures. A model of a tundish was constructed for water modeling tests and was provided with an interior geometry according to FIG. 12. However, dam 20 was not provided with a dam opening 22.

Layer A corresponds to the vertical dimension 42 of outlet periphery floor structure 28. Layer A is bounded below by the lower surface 39*a* of refractory outlet periphery floor structure 28 (equivalent to the floor of well 26), and is bounded above by the upper surface 37*a*, 37*b* of refractory outlet periphery floor structure 28.

Layer B is bounded below by the upper surface 37*a*, 37*b* of outlet periphery floor structure 28 and is bounded above by the horizontal plane of height 44 of refractory barrier 32.

Layer C is bounded below by the horizontal plane of height 44 of refractory barrier 32, and is bounded above by the horizontal plane of the upper surface of floor 12.

A combination of layers D and E is bounded below by the horizontal plane of the upper surface of floor 12, and is bounded above by the horizontal plane of the upper extent of dam 20.

Layer F is bounded below by the horizontal plane of the upper extent of dam 20, and is bounded above by the horizontal plane of maximum bath height of steel 48.

The total working volume of the tundish is defined as the volume bounded below by the floor of well 26 and above by the maximum bath height of steel 48, and encompasses layers A, B, C, D, E and F. The vertical dimension of the total working volume of the tundish is the vertical distance between the floor of well 26 and the maximum bath height of steel 48.

Layer A may have a vertical dimension from and including 0.1% to and including 5% of the vertical dimension of the total working volume of the tundish.

Layer B may have a vertical dimension from and including 0.5% to and including 25% of the vertical dimension of the total working volume of the tundish.

Layer C may have a vertical dimension from and including 0% or 0.1% to and including 5% of the vertical dimension of the total working volume of the tundish.

The combination of Layers D and E may have a vertical dimension from and including 2.5% to and including 25% of the vertical dimension of the total working volume of the tundish, from and including 30% to and including 50% of the vertical dimension of the total working volume of the tundish, from and including 25% to and including 60% of the vertical dimension of the total working volume of the tundish, or from and including 30% to and including 60% of the vertical dimension of the total working volume of the tundish. The ratio of the height of Layer D to the height of Layer E may have a value from and including 0.02:1 (or 0.02) to and including 1:1 (or 1), from and including 0.02:1 (or 0.02) to and including 0.1:1, (or 0.1) or from and including 0.02:1 (or 0.02) to and including 0.04:1 (or 0.04).

Layer F may have a vertical dimension from and including 25% to and including 90% of the vertical dimension of the total working volume of the tundish.

EXAMPLE II

Experiments and testing using physical water modeling techniques show the presence of distinct layers distinguished by differences in temperature over time through simulations of real world casting procedures.

A model of a tundish according to the invention was constructed to analyze temperatures, over time, at different positions within the tundish model. The tundish model was constructed at one-third the size of the tundish it simulates. The tundish is provided with dams with openings. The tundish dimensions, taken as being twice the respective dimensions of the model for calculation purposes, are: Layer A=30 mm, Layer B=95 mm, Layer C=0 mm, Layer D=10 mm, Layer E=280 mm, and Layer F=585 mm. $A_{fs}$, being the interior surface area of the refractory outlet periphery floor structure in communication with steel, has a value of 638191.94 square mm. $A_r$, being the surface area of the well covered by the refractory outlet periphery floor structure, has a value of 461291.01 square mm (not including area covered by the refractory barrier), or 565338.47 square mm (including area covered by the refractory barrier). Therefore, the ratio $A_{fs}/A_r$ is 1.38 if $A_r$ does not include the area covered by the refractory barrier, or 1.13 if $A_r$ includes the area covered by the refractory barrier.

Tundish dimension $D_{rb}$, the height of the refractory floor barrier, is 125 mm. Tundish dimension $D_r$, being the height of the refractory outlet periphery floor structure, is 30 mm. Tundish dimension $A_{up}$, being the area of openings on the refractory outlet periphery floor structure, is 493953.15 square mm, not including the area covered by the refractory barrier, or 604135.63 square mm, including the area covered by the refractory barrier. The resulting ratios are: $D_r/D_{rb}$=0.24, $A_{fs}/A_r$=1.38 (with $A_r$ not including the area covered by the refractory barrier) and 1.13 (with $A_r$ including the area covered by the refractory barrier), and $A_{up}/A_u$=0.45 (with $A_u$ not including area covered by the refractory barrier) and 0.37 (with $A_u$ including area covered by the refractory barrier).

Table I is a table of temperatures over time from thermocouples placed inside a scale model of a tundish used for water modeling tests through two cycles of drain and refill of a ladle exchange procedure common in the continuous casting of steel. The second column lists inlet fluid temperatures. Positions B, C and D are occupied by thermocouples (corresponding to thermocouples 82, 83 and 84, respectively, in FIGS. 10 and 11) placed inside the open volume of the bottommost layer. The thermocouple at Position A (corresponding to thermocouple 81 in FIGS. 10 and 11) measures the temperature at the outlet of the tundish. The thermocouples at Positions E and F (corresponding to thermocouples 85 and 86, respectively, in FIGS. 10 and 11) provide temperature readings above the open volume of the bottommost layer. This shows that the temperature and very likely density of the fluid inside of the open volume of the bottommost layer behaves very differently than the main bulk of fluid above it and is not susceptible to mixing, thus changing temperature over time with the inlet temperature. Several other tests have been done by varying the geometries and the placement of the pieces. These tests show that the multiple layers defined by the pieces and their placement according to the invention are required to recreate this behavior.

TABLE I

Temperatures at Specified Locations in Water Model of Tundish

| Time (sec) | Inlet Temp. (deg C.) | Position A (deg C.) | Position B (deg C.) | Position C (deg C.) | Position D (deg C.) | Position E (deg C.) | Position F (deg C.) |
|---|---|---|---|---|---|---|---|
| 0 | 10.016 | 6.565 | 6.526 | 6.505 | 6.494 | 6.754 | 6.782 |
| 50 | 9.972 | 6.561 | 6.342 | 6.385 | 6.357 | 6.754 | 6.786 |
| 100 | 10.026 | 7.077 | 6.248 | 6.326 | 6.287 | 7.589 | 7.900 |
| 150 | 9.900 | 7.781 | 6.274 | 6.313 | 6.269 | 8.352 | 8.427 |
| 200 | 9.627 | 8.293 | 6.239 | 6.283 | 6.242 | 8.442 | 8.625 |
| 250 | 9.474 | 8.511 | 6.201 | 6.250 | 6.190 | 8.759 | 8.842 |
| 300 | 9.278 | 8.602 | 6.188 | 6.238 | 6.162 | 8.810 | 8.965 |
| 350 | 9.073 | 8.716 | 6.179 | 6.230 | 6.151 | 8.874 | 8.991 |
| 400 | 8.850 | 8.746 | 6.190 | 6.229 | 6.144 | 8.964 | 8.991 |
| 450 | 8.694 | 8.719 | 6.189 | 6.227 | 6.143 | 8.949 | 8.993 |
| 500 | 8.470 | 8.700 | 6.239 | 6.250 | 6.131 | 8.884 | 8.909 |
| 550 | 8.263 | 8.601 | 6.276 | 6.273 | 6.155 | 8.767 | 8.863 |
| 600 | 8.038 | 8.481 | 6.266 | 6.339 | 6.138 | 8.707 | 8.815 |
| 650 | 7.842 | 8.341 | 6.300 | 6.380 | 6.185 | 8.503 | 8.689 |
| 700 | 7.572 | 8.230 | 6.280 | 6.518 | 6.166 | 8.477 | 8.500 |
| 750 | 7.394 | 8.045 | 6.417 | 6.625 | 6.344 | 8.204 | 8.405 |
| 800 | 7.191 | 7.870 | 6.432 | 6.657 | 6.524 | 8.041 | 8.274 |
| 850 | 6.964 | 7.714 | 6.560 | 6.723 | 6.612 | 7.876 | 8.180 |
| 900 | 6.793 | 7.523 | 6.641 | 6.729 | 6.662 | 7.689 | 7.940 |
| 950 | 6.569 | 7.327 | 6.652 | 6.718 | 6.656 | 7.508 | 7.687 |
| 1000 | 6.386 | 7.134 | 6.740 | 6.740 | 6.709 | 7.341 | 7.605 |
| 1050 | 6.135 | 7.017 | 6.700 | 6.689 | 6.668 | 7.120 | 7.411 |
| 1100 | 5.957 | 6.856 | 6.630 | 6.633 | 6.609 | 7.026 | 7.204 |
| 1150 | 5.773 | 6.659 | 6.585 | 6.576 | 6.564 | 6.812 | 7.035 |

TABLE I-continued

| Temperatures at Specified Locations in Water Model of Tundish | | | | | | | |
|---|---|---|---|---|---|---|---|
| Time (sec) | Inlet Temp. (deg C.) | Position A (deg C.) | Position B (deg C.) | Position C (deg C.) | Position D (deg C.) | Position E (deg C.) | Position F (deg C.) |
| 1200 | 5.582 | 6.457 | 6.534 | 6.532 | 6.471 | 6.590 | 6.846 |
| 1250 | 9.961 | 6.283 | 6.354 | 6.366 | 6.311 | 6.440 | 6.631 |
| 1300 | 10.032 | 6.186 | 6.206 | 6.213 | 6.093 | 6.312 | 6.469 |
| 1350 | 9.996 | 6.539 | 6.167 | 6.171 | 6.162 | 6.554 | 7.098 |
| 1400 | 9.906 | 7.341 | 6.143 | 6.148 | 6.098 | 7.792 | 8.167 |
| 1450 | 9.750 | 7.853 | 6.121 | 6.129 | 6.097 | 8.145 | 8.297 |
| 1500 | 9.470 | 8.164 | 6.087 | 6.102 | 6.065 | 8.455 | 8.640 |
| 1550 | 9.342 | 8.415 | 6.065 | 6.086 | 6.045 | 8.677 | 8.804 |
| 1600 | 9.121 | 8.570 | 6.055 | 6.073 | 6.017 | 8.786 | 8.833 |
| 1650 | 8.906 | 8.628 | 6.051 | 6.065 | 6.002 | 8.886 | 8.914 |
| 1700 | 8.673 | 8.622 | 6.056 | 6.063 | 5.995 | 8.881 | 8.937 |
| 1750 | 8.448 | 8.643 | 6.068 | 6.066 | 5.994 | 8.883 | 8.913 |
| 1800 | 8.264 | 8.575 | 6.096 | 6.077 | 6.004 | 8.796 | 8.871 |
| 1850 | 8.092 | 8.496 | 6.114 | 6.100 | 5.996 | 8.753 | 8.799 |
| 1900 | 7.866 | 8.354 | 6.132 | 6.171 | 6.017 | 8.523 | 8.661 |
| 1950 | 7.658 | 8.260 | 6.161 | 6.316 | 6.038 | 8.497 | 8.598 |
| 2000 | 7.433 | 8.097 | 6.136 | 6.340 | 6.039 | 8.258 | 8.431 |
| 2050 | 7.223 | 7.949 | 6.276 | 6.429 | 6.161 | 8.135 | 8.304 |
| 2100 | 7.027 | 7.760 | 6.266 | 6.377 | 6.364 | 7.896 | 8.149 |
| 2150 | 6.824 | 7.608 | 6.366 | 6.484 | 6.464 | 7.761 | 7.934 |
| 2200 | 6.607 | 7.407 | 6.455 | 6.562 | 6.487 | 7.527 | 7.723 |
| 2250 | 6.393 | 7.252 | 6.476 | 6.516 | 6.490 | 7.386 | 7.598 |
| 2300 | 6.185 | 7.096 | 6.533 | 6.518 | 6.499 | 7.314 | 7.409 |
| 2350 | 5.990 | 6.879 | 6.516 | 6.478 | 6.464 | 7.039 | 7.223 |
| 2400 | 5.791 | 6.717 | 6.493 | 6.443 | 6.434 | 6.836 | 7.083 |
| 2450 | 5.6020 | 6.549 | 6.418 | 6.388 | 6.369 | 6.685 | 6.910 |

Position A: Strand/Nozzle/Outlet of Tundish

Position B: Inside Cavity of Refractory Outlet Periphery Floor Structure between Outlet and Wall Distal to Inlet Position C: Inside Cavity of Refractory Outlet Periphery Floor Structure between Well Step and Refractory Barrier Position D: Inside Cavity of Refractory Outlet Periphery Floor Structure between Well Step and Refractory Barrier Position E: Above Nozzle/Outlet Above Floor 12 at Mid Level Position F: Above Nozzle/Outlet Near Meniscus

EXAMPLE III

A tundish according to the invention may be configured so that volumes, the heights and depths of various elements, and the vertical thicknesses of layers that are defined by the elements, are related in the following fashion:

Layer A corresponds to the vertical dimension 42 of outlet periphery floor structure 28. Layer A is bounded below by the lower surface 39*a* of refractory outlet periphery floor structure 28 (equivalent to the floor of well 26), and is bounded above by the upper surface 37*a*, 37*b* of refractory outlet periphery floor structure 28.

Layer B is bounded below by the upper surface 37*a*, 37*b* of outlet periphery floor structure 28 and is bounded above by the horizontal plane of height 44 of refractory barrier 32.

Layer C is bounded below by the horizontal plane of height 44 of refractory barrier 32, and is bounded above by the horizontal plane of the upper surface of floor 12.

Layer D is bounded below by the horizontal plane of the upper surface of floor 12, and is bounded above by the horizontal plane of the lowest extent of dam opening 22 in dam 20, and corresponds to dam opening height 40 in FIG. 1.

Layer E is bounded below by the horizontal plane of the lowest extent of dam opening 22 in dam 20, and is bounded above by the horizontal plane of the upper extent of dam 20.

Layer F is bounded below by the horizontal plane of the upper extent of dam 20, and is bounded above by the horizontal plane of maximum bath height of steel 48.

The total working volume of the tundish is defined as the volume bounded below by the floor of well 26 and above by the maximum bath height of steel 48, and encompasses layers A, B, C, D, E and F. The vertical dimension of the total working volume of the tundish is the vertical distance between the floor of well 26 and the maximum bath height of steel 48.

The well depth 46 is defined as the vertical distance between the upper surface of tundish floor 12 and the upper surface of well 26. Well depth 46 encompasses layers A, B and C. Well 26 may have a depth from and including 1%, to and including 20%, of the vertical dimension of the total working volume of tundish 10.

Layer F may have a vertical dimension from and including 10% to and including 80%, or from and including 20% to and including 60%, of the vertical dimension of the total working volume of tundish 10.

Layers D and E may have a summed vertical dimension from and including 15% to and including 85% of the vertical dimension of the total working volume of tundish 10.

Layer C may have a vertical dimension from and including 0% to and including 70% of the summed vertical dimensions of layers A, B and C.

Layers A and B may have a summed vertical dimension from and including 2% to and including 100% of the summed vertical dimensions of layers A, B and C.

Layer B may have a vertical dimension from and including 2% to and including 100% of the summed vertical dimensions of layers A and B.

Layer A may have a vertical dimension from and including 20% to and including 100% of the vertical dimension of layer B.

Layer A may have a vertical dimension from and including 20% to and including 100% of the summed vertical dimensions of layers B and C.

Layers A and B may have a summed vertical dimension from and including 5% to and including 100% of the summed vertical dimensions of layers A, B and C.

Layers A and B may have a summed vertical dimension from and including 5% to and including 100% of the summed vertical dimensions of layers D and E.

While the inventors do not wish to be bound by theory, it is believed that the difference between physical properties of the steel contained and constrained within floor structure 28 and the steel residing in other volumes in the tundish reduces the intermixing of steel within floor structure and the steel outside floor structure 28, and shields the main bulk of steel outside of the refractory outlet periphery floor structure from contact with, and reaction with, impurities; the impurities being sequestered.

The invention also relates to a process for the maintenance or improvement of the integrity of steel quality supplied to a mold, comprising (a) introducing molten metal into the tundish pour volume of a tundish according to the invention, (b) transferring the molten metal from the tundish pour volume to the tundish outlet, and (c) withdrawing the molten metal from the tundish outlet.

The invention also relates to the use of a tundish, as herein described, for the maintenance or improvement of the integrity of steel quality to the mold, in which molten metal is introduced into the tundish pour volume of a tundish according to the invention, molten metal is transferred from the tundish pour volume to the tundish outlet, and molten metal is withdrawn from the tundish outlet.

Various features and characteristics are described in this specification and illustrated in the drawings to provide an overall understanding of the invention. It is understood that the various features and characteristics described in this specification and illustrated in the drawings can be combined in any operable manner regardless of whether such features and characteristics are expressly described or illustrated in combination in this specification. The Inventors and the Applicant expressly intend such combinations of features and characteristics to be included within the scope of the invention, and further intend the claiming of such combinations of features and characteristics to not add matter to the application. The invention can comprise, consist of, or consist essentially of the various features and characteristics described in this specification.

The claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims, and will comply with written description, sufficiency of description, and added matter requirements (e.g., 35 U.S.C. § 112(a) and Article 123(2) EPC).

Also, any numerical range recited in this specification includes the recited endpoints and describes all sub-ranges of the same numerical precision (i.e., having the same number of specified digits) subsumed within the recited range. For example, a recited range of "1.0 to 10.0" describes all sub-ranges between (and including) the recited minimum value of 1.0 and the recited maximum value of 10.0, such as, for example, "2.4 to 7.6," even if the range of "2.4 to 7.6" is not expressly recited in the text of the specification. Accordingly, the Applicant reserves the right to amend this specification, including the claims, to expressly recite any sub-range of the same numerical precision subsumed within the ranges expressly recited in this specification. All such ranges are inherently described in this specification such that amending to expressly recite any such sub-ranges will comply with written description, sufficiency of description, and added matter requirements (e.g., 35 U.S.C. § 112(a) and Article 123(2) EPC).

The grammatical articles "one", "a", "an", and "the", as used in this specification, are intended to include "at least one" or "one or more", unless otherwise indicated or required by context. Thus, the articles are used in this specification to refer to one or more than one (i.e., to "at least one") of the grammatical objects of the article. By way of example, "a component" means one or more components, and thus, possibly, more than one component is contemplated and can be employed or used in an implementation of the invention. Further, the use of a singular noun includes the plural, and the use of a plural noun includes the singular, unless the context of the usage requires otherwise.

ASPECTS OF THE INVENTION

Various aspects of the invention include, but are not limited to, the following numbered clauses:

1. A tundish, comprising:

a floor having an outlet, said outlet having an upper end, and a pour volume horizontally displaced from said outlet;

side walls extending upwardly from said floor, said side walls extending above the normal maximum operating level of molten steel in said tundish, the floor and side walls partially defining a tundish interior;

an impact surface positioned on said tundish floor beneath said pour volume;

a refractory barrier disposed circumferentially around the upper end of said outlet and having a height $D_{rb}$;

a refractory outlet periphery floor structure disposed on the floor of the tundish and surrounding the outlet, having an upper surface and a lower surface, and having a configuration providing an interior open volume open to the exterior of the structure;

and at least one floor structure, in communication with said floor, selected from the group consisting of at least one of:

(a) a well in said floor of said tundish surrounding said outlet, said well having an upper surface; and (b) a dam positioned on said floor between said impact surface and said outlet;

wherein the refractory outlet periphery floor structure has a configuration selected from the group consisting of at least one of:

(a) comprising an opening in the upper surface of the refractory outlet periphery floor structure, wherein the opening has a hexagonal cross section in the plane of the upper surface of the refractory outlet periphery floor structure;

(b) wherein the ratio of the surface area of the refractory outlet periphery floor structure in fluid communication with the tundish interior ($A_{fs}$) to the surface area of the portion of the tundish floor covered by the refractory outlet periphery floor structure ($A_r$) is equal to or greater than 1.1; and (c) wherein the ratio of the area of all openings in the upper surface of the refractory outlet periphery floor structure ($A_{up}$) to the area of the upper surface of the refractory outlet periphery floor structure ($A_u$) has a value from and including 0.1 to and including 0.9.

2. The tundish of clause 1, wherein the ratio $A_{fs}/A_r$ has a value between 1 and 2, and wherein the ratio $A_{up}/A_u$ has a value between 0.2 and 0.8.
3. The tundish of clause 1, wherein the ratio $A_{fs}/A_r$ has a value between 1.2 and 1.6, and wherein the ratio $A_{up}/A_u$ has a value between 0.3 and 0.6.
4. The tundish of clause 1, wherein said floor structure comprises a well having a well depth.
5. The tundish of clause 1, wherein said floor structure comprises a dam having a dam height.
6. The tundish of clause 1, wherein said floor structure comprises a well having a well depth and a dam having a dam height.
7. The tundish of clause 5, wherein said dam extends upwardly from said floor a distance between 30% and 60% of the normal maximum operating level of molten steel in said tundish.
8. The tundish of clause 5, wherein said dam has at least one opening therein allowing the passage of molten steel therethrough, so that molten steel may flow over said dam and through said at least one opening.
9. The tundish of clause 8, wherein the center of each opening allowing passage of steel therethrough is located at a position between 3% and 70% of the dam height.
10. The tundish of any of clauses 1-9, wherein the refractory outlet periphery floor structure is selected from the group consisting of a mesh, a network, a lattice, a honeycomb, a grate and combinations thereof.
11. The tundish of any of clauses 1-10, wherein the refractory outlet periphery floor structure has an interior open volume in the range from at least 20% to at most 80% of the total volume of the structure.
12. The tundish of any of clauses 1-11, wherein the interior open volume of the refractory outlet periphery floor structure consists of openings to the upper surface of the refractory outlet periphery floor structure in which the linear dimension of the openings in the vertical direction is at least 40% of the greatest linear dimension of the openings in the horizontal direction.
13. The tundish of any of clauses 1-12, in which the openings to the upper surface of the refractory outlet periphery floor structure have constrictions at the upper surface of the refractory outlet periphery floor structure.
14. The tundish of any of clauses 1-13, wherein the refractory outlet periphery floor structure completely covers said well upper surface.
15. The tundish of any of clauses 1-14, wherein ratio of the distance between the lower surface of the refractory outlet periphery floor structure and the upper surface of the refractory outlet periphery floor structure ($D_r$) and the height of the refractory barrier ($D_{rb}$) has a value from and including 0.1:1.0 (0.1) to and including 0.9:1.0 (or 0.9), or from and including 0.1:1.0 (or 0.1) to and including 0.6:1.0 (or 0.6).
16. The tundish of any of clauses 1-15, wherein the ratio of the surface area of the refractory outlet periphery floor structure in fluid communication with the tundish interior ($A_{fs}$) to the surface area of the portion of the tundish floor covered by the refractory outlet periphery floor structure ($A_r$) has a value from and including 1.1:1 (or 1.1) to and including 2:1 (or 2) wherein $A_r$ does not include area covered by the refractory barrier, or a value from and including 1.1:1 (or 1.1) to and including 2:1 (or 2) wherein $A_r$ does include area covered by the refractory barrier.
17. The tundish of any of clauses 1-16, wherein the ratio of the area of all openings in the upper surface of the refractory outlet periphery floor structure ($A_{up}$) to the area of the upper surface of the refractory outlet periphery floor structure ($A_u$) has a value from and including 0.2:1.0 (or 0.2) to and including 0.8:1.0 (or 0.8).
18. A process for sequestering impurities from molten metal, comprising:
    (a) introducing the molten metal into the pour volume of a tundish according to any of clauses 1-17;
    (b) passing the molten metal from the pour volume of the tundish to the outlet; and
    (c) withdrawing the molten metal from the outlet of the tundish.

ELEMENTS

10. Tundish
12. Tundish floor
14. Tundish walls
15. Tundish interior volume
16. Tundish outlet
18. Tundish pour volume
20. Dam
22. Dam opening
24. Well step
26. Well
28. Refractory outlet periphery floor structure
31*a*. Individual cell of the refractory outlet periphery floor structure
31*b*. Individual cell of the refractory outlet periphery floor structure
32. Refractory barrier
33*a*. Interior bottom surface of cells
33*b*. Interior bottom surface of cells
35*a*. Interior side walls
35*b*. Side walls
36*a*. Upper openings of cells
36*b*. Upper openings of cells
37*a*. Upper surface of refractory outlet periphery floor structure
37*b*. Upper surface of refractory outlet periphery floor structure
38*a*. Lower openings of cells
39*a*. Lower surface of refractory outlet periphery floor structure
39*b*. Lower surface of refractory outlet periphery floor structure
40. Dam opening height
41. Dam height
42. Refractory outlet periphery floor structure height
44. Refractory barrier height
46. Well depth
52. Pour volume flow direction
54. Direction of flow from dam
60. Tundish pour nozzle
64. Dam face
66. Individual cell of the refractory outlet periphery floor structure
68. Minimum horizontal dimension of cell constriction
70. Maximum horizontal dimension of cell interior
81. First thermocouple
82. Second thermocouple
83. Third thermocouple
84. Fourth thermocouple
85. Fifth thermocouple
101. Layer A

102. Layer B
103. Layer C
104. Layer D
105. Layer E
106. Layer F

What is claimed is:

1. A tundish, comprising:

a floor having an outlet, said outlet having an upper end, and a pour volume horizontally displaced from said outlet;

side walls extending upwardly from said floor, said side walls extending above a normal maximum operating level of molten steel in said tundish, the floor and side walls partially defining a tundish interior;

an impact surface positioned on said tundish floor beneath said pour volume;

a refractory barrier disposed circumferentially around the upper end of said outlet and having a height $D_{rb}$;

a refractory outlet periphery floor structure disposed on the floor of the tundish and surrounding the outlet, having an upper surface and a lower surface, the upper surface describing a plane the refractory outlet periphery floor structure having an exterior, and the refractory outlet periphery floor structure having a configuration providing an interior open volume open to the exterior of the refractory outlet periphery floor structure;

and at least one well or dam structure, in communication with said floor, selected from a group consisting of:

a well in said floor of said tundish surrounding said outlet, said well having a well depth and an upper surface; and a dam positioned on said floor between said impact surface and said outlet, said dam having a dam height;

wherein the refractory outlet periphery floor structure comprises a plurality of openings in the upper surface of the refractory outlet periphery floor structure, wherein the openings have a hexagonal cross section in the plane of the upper surface of the refractory outlet periphery floor structure, and wherein the refractory outlet periphery floor structure has a configuration selected from a group consisting of:

(a) wherein the ratio of a surface area of the refractory outlet periphery floor structure in fluid communication with the tundish interior ($A_{fs}$) to a surface area of a portion of the tundish floor covered by the refractory outlet periphery floor structure ($A_r$) is equal to or greater than 1.1; and (b) wherein a ratio of an area of all openings in the upper surface of the refractory outlet periphery floor structure ($A_{up}$) to the area of the upper surface of the refractory outlet periphery floor structure ($A_u$) has a value from and including 0.1 to and including 0.9.

2. The tundish of claim 1, wherein a ratio $A_{fs}/A_r$ has a value between 1 and 2, and wherein the ratio $A_{up}/A_u$ has a value between 0.2 and 0.8.

3. The tundish of claim 1, wherein the ratio $A_{fs}/A_r$ has a value between 1.2 and 1.6, and wherein the ratio $A_{up}/A_u$ has a value between 0.3 and 0.6.

4. The tundish of claim 1, wherein said floor structure comprises a well and a dam.

5. The tundish of claim 1, comprising a dam, wherein said dam extends upwardly from said floor a distance between 40% and 60% of the normal maximum operating level of molten steel in said tundish.

6. The tundish of claim 1, comprising a dam, wherein said dam has at least one opening therein allowing passage of molten steel therethrough, so that molten steel may flow over said dam and through said at least one opening.

7. The tundish of claim 6, wherein a center of each opening allowing passage of steel therethrough is located at a position between 30% and 70% of the dam height.

8. The tundish of claim 1, wherein the refractory outlet periphery floor structure is selected from a group consisting of a mesh, a network, a lattice, a honeycomb, a grate and combinations thereof.

9. The tundish of claim 1, wherein the refractory outlet periphery floor structure has an interior open volume in a range from at least 20% to at most 80% of a total volume of the structure.

10. The tundish of claim 1, wherein the interior open volume of the refractory outlet periphery floor structure consists of openings to the upper surface of the refractory outlet periphery floor structure in which a linear dimension of the openings in a vertical direction is at least 40% of a greatest linear dimension of the openings in a horizontal direction.

11. The tundish of claim 1, wherein the openings to the upper surface of the refractory outlet periphery floor structure have constrictions at the upper surface of the refractory outlet periphery floor structure.

12. The tundish of claim 1, wherein the refractory outlet periphery floor structure completely covers said well upper surface.

13. The tundish of claim 1, wherein ratio of a distance between the lower surface of the refractory outlet periphery floor structure and the upper surface of the refractory outlet periphery floor structure ($D_r$) and the height of the refractory barrier ($D_{rb}$) has a value from and including 0.1 to and including 0.9.

14. A process for sequestering impurities from molten metal, comprising:

introducing the molten metal into the pour volume of a tundish according to claim 1;

passing the molten metal from the pour volume of the tundish to the outlet; and withdrawing the molten metal from the outlet of the tundish.

* * * * *